US005623530A

United States Patent [19]

Lu et al.

[11] Patent Number: 5,623,530

[45] Date of Patent: Apr. 22, 1997

[54] CATHODE CUP ASSEMBLY FOR AN X-RAY TUBE

[75] Inventors: Quan N. Lu; Stephen S. Waite, both of Milwaukee, Wis.

[73] Assignee: General Electric Company, Milwaukee, Wis.

[21] Appl. No.: 710,422

[22] Filed: Sep. 17, 1996

[51] Int. Cl.[6] ..... H01J 35/06

[52] U.S. Cl. ..... 378/136; 378/137; 378/138

[58] Field of Search ..... 378/119, 121, 378/125, 134, 136, 137, 138

[56] References Cited

U.S. PATENT DOCUMENTS 4,065,690 12/1977 Maeyama ..... 378/138

*Primary Examiner*—Don Wong

*Attorney, Agent, or Firm*—John S. Beulick; John H. Pilarski

[57] ABSTRACT

Cathode cup assemblies for an x-ray tube are described. In one embodiment, the cathode cup assembly includes a cathode cup and a focus tab. The cathode cup includes filament receiving channels, and each channel is sized to receive a filament. The focus tab is a plate having a filament aligning aperture. The focus tab cooperates with the cathode cup so that a periphery of the filament aligning aperture limits the positioning of the filaments within the filament receiving channels.

16 Claims, 4 Drawing Sheets

CATHODE CUP ASSEMBLY FOR AN X-RAY TUBE

FIELD OF THE INVENTION

This invention relates generally to x-ray tubes used in medical imaging and more particularly, to cathode cup assemblies for such x-ray tubes.

BACKGROUND OF THE INVENTION

In at least one known medical imaging system configuration, an x-ray source projects a fan-shaped beam which is collimated to lie within an X–Y plane of a Cartesian coordinate system and generally referred to as the "imaging plane". The x-ray beam passes through the object being imaged, such as a patient, and after being attenuated by the object, impinges upon an array of radiation detectors. The intensity of the attenuated beam radiation received at the detector array is dependent upon the attenuation of the x-ray beam by the object. Each detector element of the array produces a separate electrical signal that is a measurement of the beam attenuation at the detector location. The attenuation measurements from all the detectors are acquired separately to produce a transmission profile. Such a medical imaging system typically is referred to as a computed tomography (CT) system.

In known third generation CT systems, the x-ray source and the detector array are located on a rotatable gantry. The gantry rotates around the object to be imaged so that the angle at which the x-ray beam intersects the object constantly changes. A group of x-ray attenuation measurements, i.e., projection data, from the detector array at one gantry angle are referred to as a "view". A "scan" of the object comprises a set of views made at different gantry angles during one revolution of the x-ray source and detector. In an axial scan, projection data are processed to construct an image that corresponds to a two dimensional slice taken through the object.

One method for reconstructing an image from a set of projection data is referred to in the art as the filtered back projection technique. This process converts that attenuation measurements from a scan into integers called "CT numbers" or "Hounsfield units". which are used to control the brightness of a corresponding pixel on a cathode ray tube display.

The x-ray source, sometimes referred to as an x-ray tube, typically includes an evacuated glass x-ray envelope containing an anode and a cathode. X-rays are produced by applying a high voltage across the anode and cathode and accelerating electrons from the cathode against a focal spot on the anode. The x-rays produced by the x-ray tube diverge from the focal spot in a generally conical pattern.

Known cathode assemblies typically include a cathode cup and several current carrying filaments. Each filament includes a coil and leads extending from respective ends of the coil. The cathode cup has a filament receiving channel for each filament, and lead openings extend through the cup to each filament receiving channel.

To form the cathode assembly, filaments are inserted into the cathode cup so that each filament coil rests in a channel and the filament leads extend through the lead openings. Precise location of the filaments within the filament channels is important because such location affects operation characteristics of the x-ray tube, such as focal spot focusing. Incorrect focal spot focusing causes resolution loss and image degradation. Furthermore, if the filament is not properly positioned within a channel, the filament life may be shortened due, for example, to overheating. Accordingly, it is desirable to properly position each filament within its respective channel.

To facilitate proper positioning of each filament, filament inserts are positioned in each filament receiving channel of the cup. The inserts typically are positioned adjacent respective filament lead openings so that when a filament is inserted into the channel, the filament coil extends between the filament inserts and the filament leads extend through the filament lead openings. The inserts facilitate positioning of the filament and ensuring that each filament coil is centered within each channel.

Typically, each filament insert is welded into a respective channel. The inserts must also be precisely positioned within the channel to ensure proper filament positioning as described above. Such precise positioning of the inserts, and welding of the inserts, is time consuming and cumbersome.

It would be desirable to eliminate the time consuming and cumbersome process of positioning and welding inserts within the filament receiving channels of a cathode cup. Eliminating such inserts, however, preferably would not result in any less precise positioning of filaments within the filament receiving channels.

SUMMARY OF THE INVENTION

These and other objects may be attained in a cathode cup assembly which, in one embodiment, includes a cathode cup, current carrying filaments, and a focus tab. Each filament includes a coil and leads extending from respective ends of the coil. The cathode cup has a filament receiving channel for each filament and lead openings extend through the cup to each filament receiving channel. The filament receiving channels are positioned between two cathode cup flanges. Each flange has a slot which extends substantially parallel to the filament receiving channels.

The focus tab is configured to cooperate with the cathode cup so that the focus tab limits positioning of the filaments within the cathode cup channels. Specifically, the focus tab includes a plate with a filament aligning aperture. The plate simply slides within the cathode cup flange slots so that the periphery of the filament aligning aperture is adjacent the filament lead openings and defines a filament coil portion of each cathode cup filament receiving channel. Filaments are inserted into the cathode cup so that each filament coil rests in the filament coil portion of a channel and the filament leads extend through the lead openings. The filament aligning aperture periphery facilitates positioning of the filament coil within the filament channel by limiting the filament location.

The above described tab eliminates the time consuming and cumbersome process of positioning and welding individual inserts within the filament receiving channels of the cathode cup. The tab also enables precise positioning of filaments within the filament receiving channels so that the desired focal spot focussing is achieved.

DETAILED DESCRIPTION OF THE DRAWINGS

Figure 1:
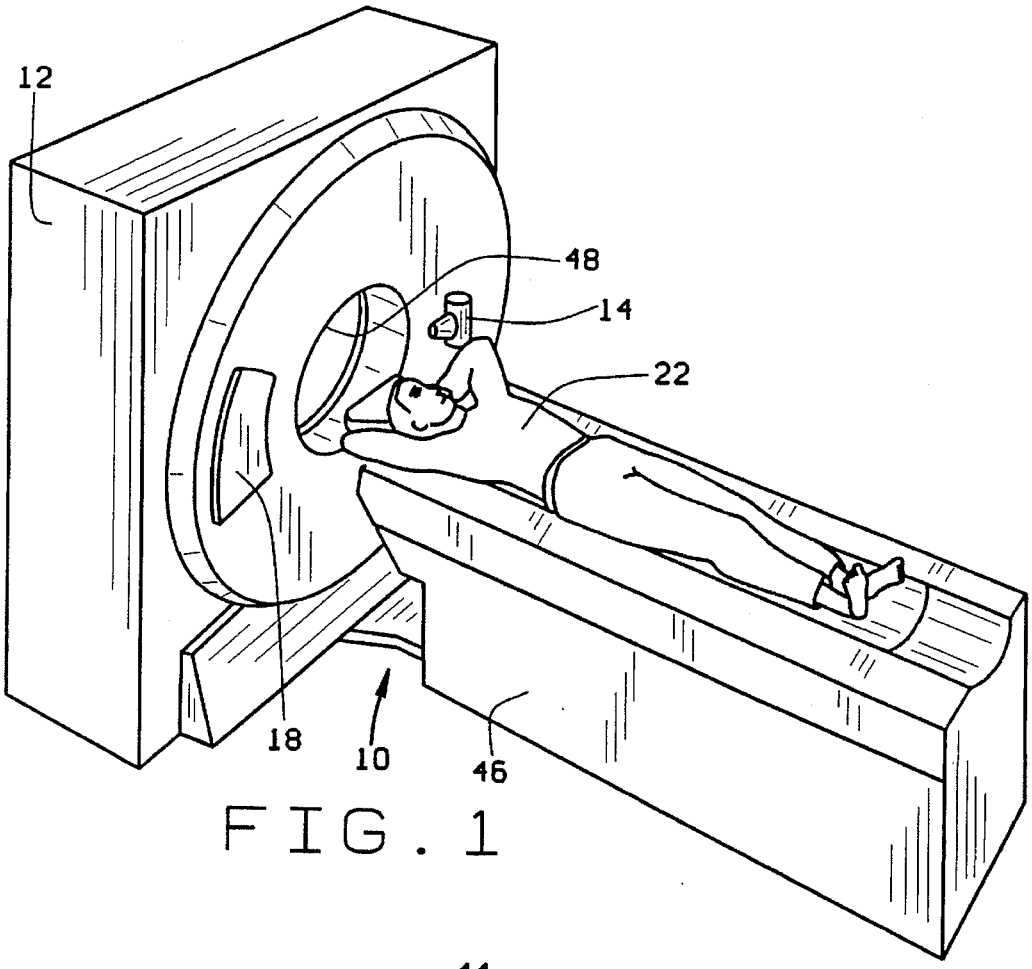
FIG. 1 is a pictorial view of a CT imaging system.
Figure 2:
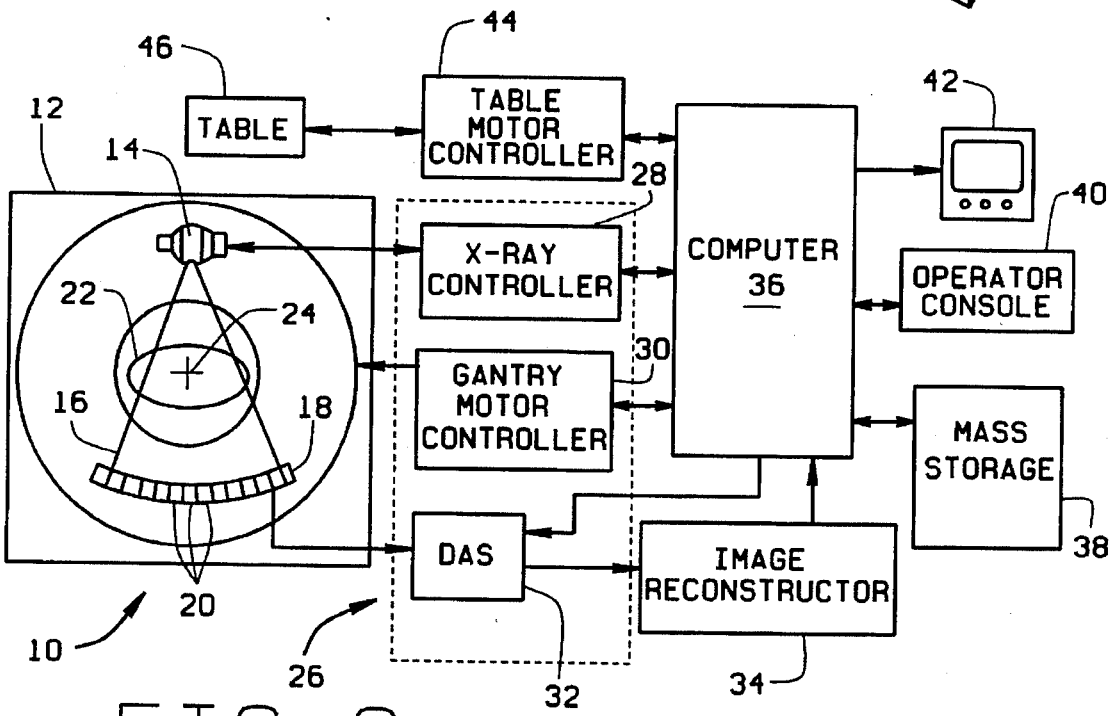
FIG. 2 is a block schematic diagram of the system illustrated in FIG. 1.

Referring to FIGS. 1 and 2, a computed tomography (CT) imaging system 10 is shown as including a gantry 12 representative of a "third generation" CT scanner. Gantry 12 has an x-ray source 14 that projects a fan beam of x-rays 16 toward a detector array 18 on the opposite side of gantry 12. Detector array 18 is formed by detector elements 20, or channels, which together sense the projected x-rays that pass through a medical patient 22. Each detector element 20 produces an electrical signal that represents the intensity of an impinging x-ray beam and hence the attenuation of the beam as it passes through patient 22. During a scan to acquire x-ray projection data, gantry 12 and the components mounted thereon rotate about a center of rotation 24.

Rotation of gantry 12 and the operation of x-ray source 14 are governed by a control mechanism 26 of CT system 10. Control mechanism 26 includes an x-ray controller 28 that provides power and timing signals to x-ray source 14 and a gantry motor controller 30 that controls the rotational speed and position of gantry 12. A data acquisition system (DAS) 32 in control mechanism 26 samples analog data from detector elements 20 and converts the data to digital signals for subsequent processing. An image reconstructor 34 receives sampled and digitized x-ray data from DAS 32 and performs high speed image reconstruction. The reconstructed image is applied as an input to a computer 36 which stores the image in a mass storage device 38.

Computer 36 also receives commands and scanning parameters from an operator via console 40 that has a keyboard. An associated cathode ray tube display 42 allows the operator to observe the reconstructed image and other data from computer 36. The operator supplied commands and parameters are used by computer 36 to provide control signals and information to DAS 32, x-ray controller 28 and gantry motor controller 30.

In addition, computer 36 operates a table motor controller 44 which controls a motorized table 46 to position patient 22 in gantry 12. Particularly, table 46 moves portions of patient 22 through gantry opening 48.

Figure 3:
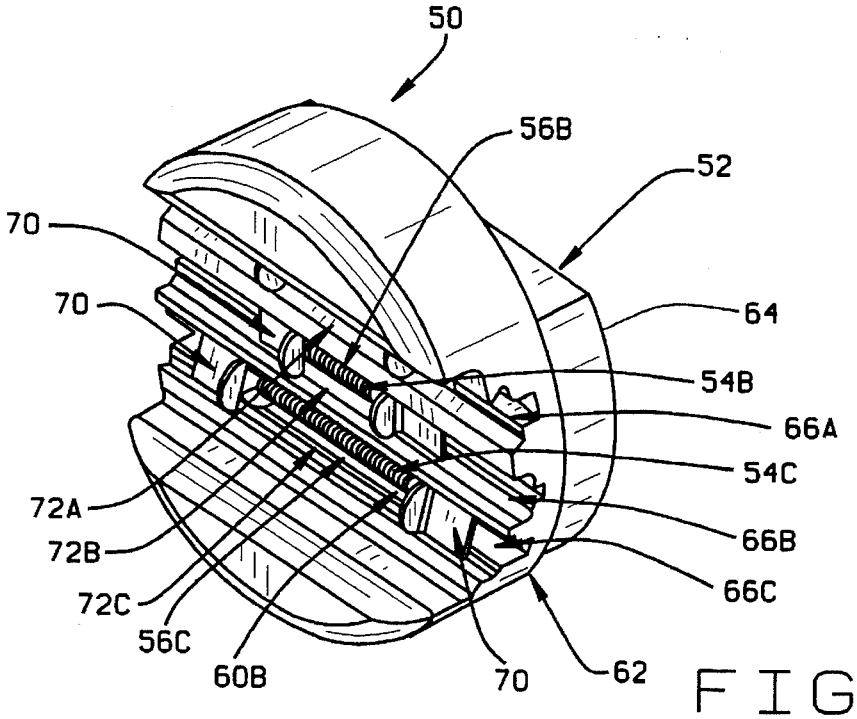
FIG. 3 is a perspective view of a known cathode assembly.
Figure 4:
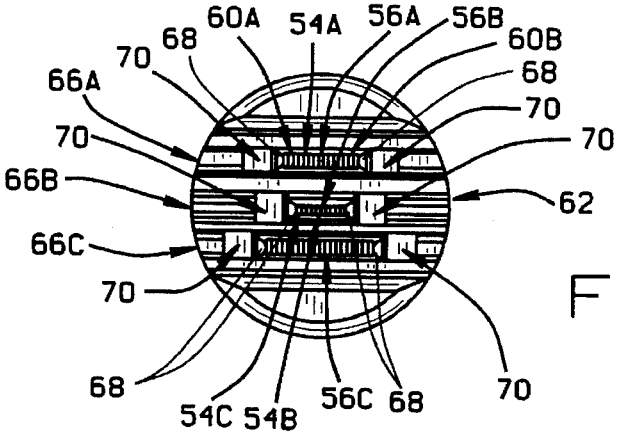
FIG. 4 is a front elevation view of the cathode assembly of FIG. 3.
Figure 5:
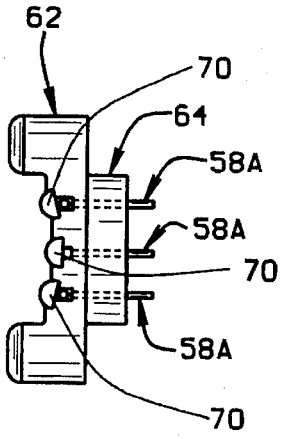
FIG. 5 is a side elevation view of the cathode assembly of FIG. 3.

FIGS. 3, 4 and 5 illustrate a known cathode cup assembly 50 including a cathode cup 52 and three filaments 54A, 54B, and 54C. Filaments 54A, 54B, and 54C each include a filament coil 56A, 56B, and 56C and leads 58A and 58B (not shown) extending from respective ends 60A and 60B of filament coils 56A, 56B, and 56C. Cathode cup 52 includes a filament coil receiving portion 62 and a filament lead extension portion 64. Filament coil receiving portion 62 has a filament receiving channel 66A, 66B, and 66C for each filament 54A, 54B, and 54C, and filament lead openings 68 extend through cathode cup 52 to respective filament receiving channels 66A, 66B, and 66C.

Filament welding inserts 70 are located in channels 66A, 66B, and 66C to define filament coil portions 72A, 72B, and 72C of channels 66A, 66B, and 66C. Particularly, filament welding inserts 70 are welded within channels 66A, 66B, and 66C so that each filament coil portion 72A, 72B, and 72C is centered within its respective channel 66A, 66B, and 66C. Furthermore, each pair of welding inserts 70 in channels 66A, 66B, and 66C, is positioned so that coils 56A, 56B, and 56C are positioned to provide the desired focal spot focusing. Filament welding inserts 70 are adjacent respective filament lead openings 68 so that when filaments 54A, 54B, and 54C, are inserted into channels 66A, 66B, and 66C, filament coils 56A, 56B, and 56C extend between respective filament welding inserts 70, and filament leads 58A and 58B extend through filament lead openings 68.

As is known, filament welding inserts 70 are typically welded within channels 66A, 66B, and 66C to limit the positioning of filament coils 56A, 56B, and 56C within channels 66A, 66B, and 66C. Welding each filament welding insert 70, however, often is time consuming and cumbersome.

In accordance with one embodiment of the present invention, a single-piece focus tab is used to center filament coils within filament receiving channels of a cathode cup so that the desired focal spot focussing is achieved. The focus tab is secured to the cathode cup without any welding, thus eliminating the costly and time consuming welding process.

Figure 6:
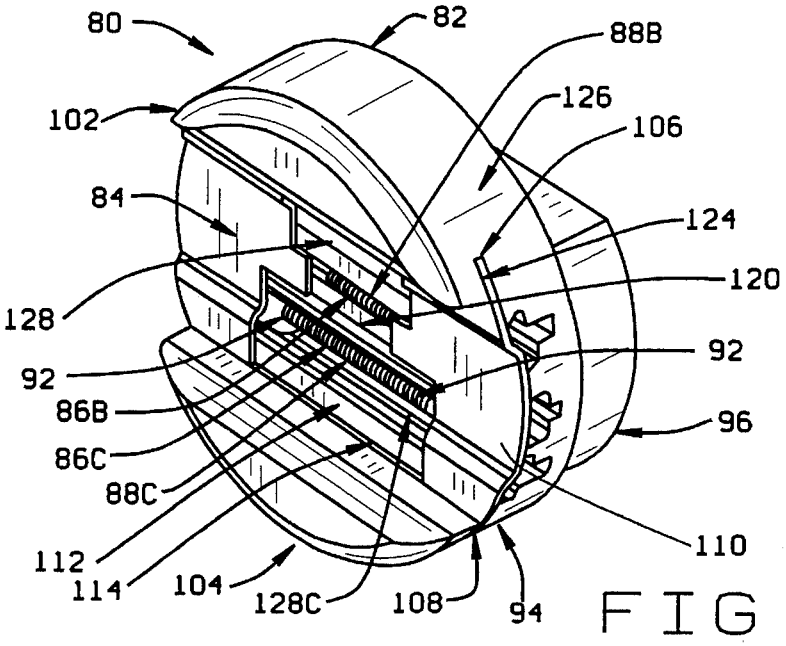
FIG. 6 is a perspective view of a cathode cup assembly in accordance with one embodiment of the present invention.
Figure 7:
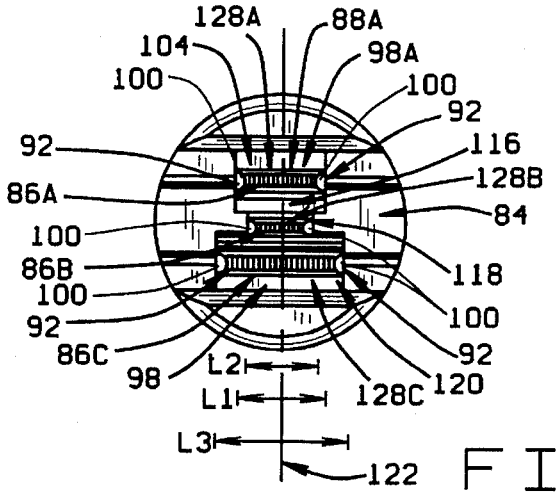
FIG. 7 is a front elevation view of the cathode cup assembly of FIG. 6.
Figure 8:
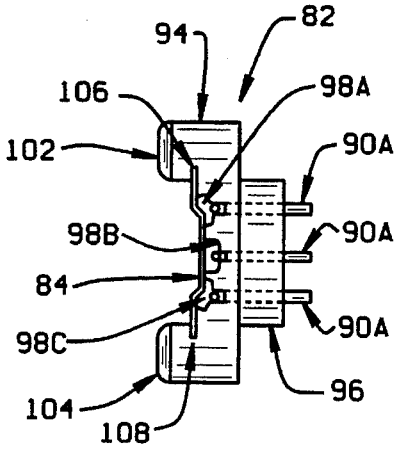
FIG. 8 is a side elevation view of the cathode cup assembly of FIG. 6.

FIGS. 6, 7 and 8 illustrate one embodiment of the present invention. Specifically, a cathode cup assembly 80 includes a cathode cup 82, a focus tab 84, and filaments 86A, 86B, and 86C. Filaments 86A, 86B, and 86C include filament coils 88A, 88B, and 88C and filament leads 90A and 90B (not shown) extending from respective ends 92 of filament coils 88A, 88B, and 88C. Cathode cup 82 includes a filament coil receiving portion 94 and a filament lead extension portion 96. As shown, filament lead extension portion 96 is integral with filament coil receiving portion 94. Filament coil receiving portion 94 includes filament receiving channels 98A, 98B, and 98C for each filament 86A, 86B, and 86C, and filament lead openings 100 extend through cathode cup 82 to respective channels 98A, 98B, and 98C. Each filament receiving channel 98A, 98B, and 98C is sized to receive one of respective filaments 86A, 86B, and 86C.

Filament coil receiving portion 94 further includes a first flange 102 and a second flange 104, and channels 98A, 98B, and 98C are located between first and second flanges 102 and 104. First flange 102 has a first slot 106 and second flange 104 has a second slot 108. Slots 106 and 108, as shown, are substantially parallel to channels 98A, 98B, and 98C.

Focus tab 84 includes a plate 110 having a filament aligning aperture 112 therein. A periphery 114 of filament aligning aperture 112 defines three parallel aperture portions 116, 118 and 120. Each aperture portion 116, 118 and 120 has a respective length L1, L2, and L3, and is symmetrical about a mirror image line 122 of focus tab 84. As shown, lengths L1, L2 and L3 are each different lengths. Cathode cup 82 and focus tab 84 are, for example, stainless steel.

Focus tab 84 is configured to cooperate with cathode cup 82 to facilitate proper positioning of filaments 86A, 86B, and 86C within filament coil receiving portion 94 so that the desired focal spot focussing is achieved. Particularly, focus tab 84 is inserted into filament coil receiving portion 94 so that focus tab 84 at least partially covers channels 98A, 98B, and 98C, and filament aligning aperture periphery 114 limits positioning of filaments 86A, 86B, and 86C within channels 98A, 98B, and 98C. More particularly, focus tab 84 slides into engagement with slots 106 and 108 so that an outer periphery 124 of focus tab 84 is substantially coextensive with an outer periphery 126 of filament coil receiving portion 94. Periphery 114 of filament aligning aperture 112 is adjacent channels 98A, 98B, and 98C so that each aperture portion 116, 118 and 120 defines filament coil portions 128A, 128B, and 128C of channels 98A, 98B, and 98C of respective lengths L1, L2, and L3. In addition, periphery 114 is adjacent respective filament lead openings 100. Filaments 86A, 86B, and 86C are inserted into cathode cup 82 so that filament coils 88A, 88B, and 88C rest in respective filament coil portions 128A, 128B, and 128C of channels 98A, 98B, and 98C, and filament leads 90A and 90B extend through filament lead openings 100.

Figure 9:
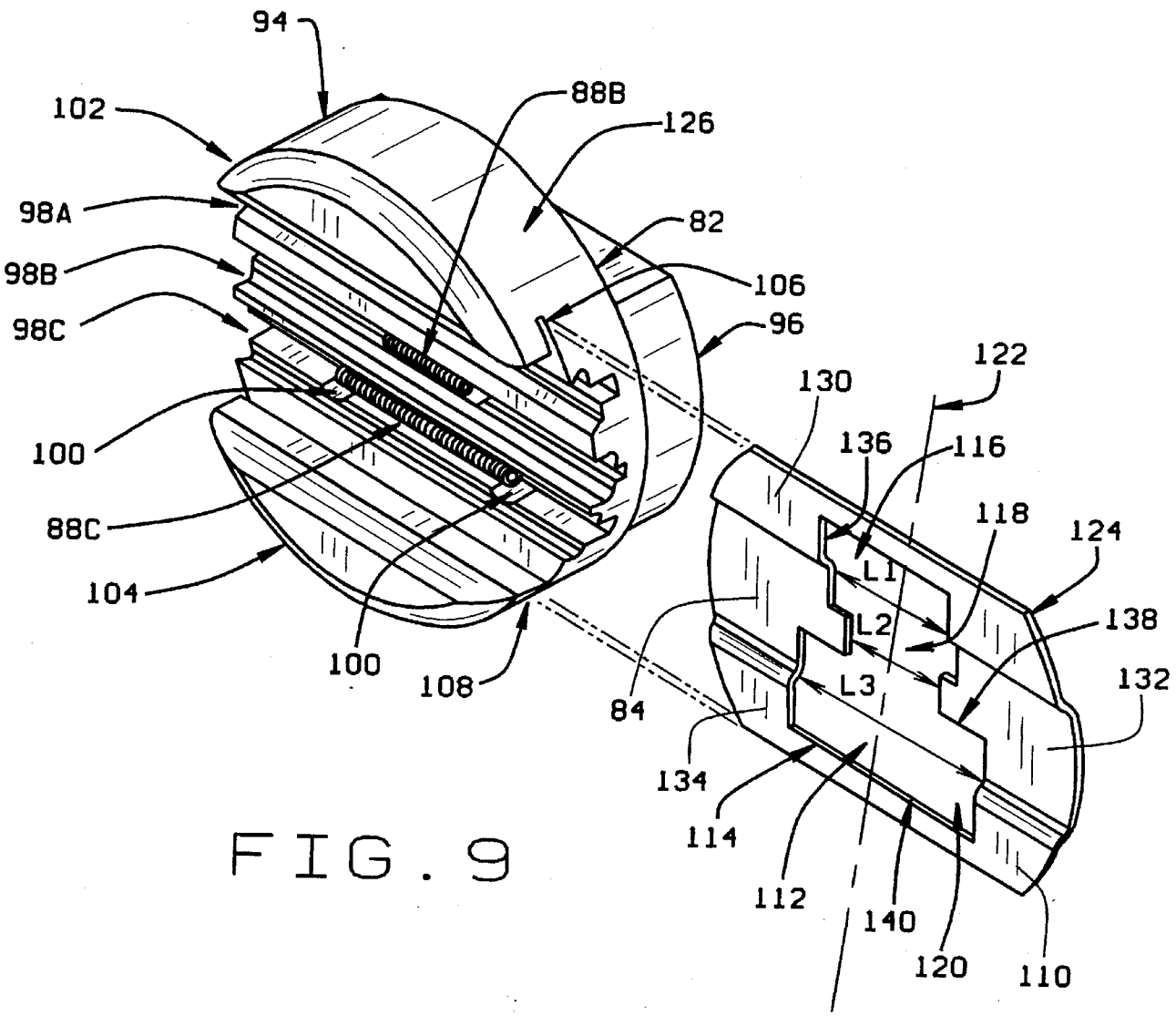
FIG. 9 is a perspective exploded view of the cathode cup assembly of FIG. 6.

Referring to FIG. 9, focus tab 84 includes a first end portion 130, an intermediate portion 132, and a second end portion 134. Focus tab first end portion 130 is configured to slide into slot 106 and focus tab second end portion 134 is configured to slide into slot 108. As shown, filament aligning aperture 112 extends through each portion 130, 132 and 134. Particularly, each portion 130, 132 and 134 includes an aperture defining surface 136, 138 and 140, respectively. First end portion 130 is adjacent intermediate portion 132 and aligned with intermediate portion 132 so that aperture defining surfaces 136 and 138 are aligned. As shown, first end portion aperture defining surface 136 and intermediate portion aperture defining surface 138 define filament aligning aperture portion 116 with length L1. Intermediate portion aperture defining surface 138 also defines filament aligning aperture portion 118 with length L2. Intermediate portion 132 is adjacent second end portion 134 and aligned with second end portion 134 so that aperture defining surfaces 138 and 140 are aligned. Particularly, intermediate portion aperture defining surface 138 and second end aperture defining surface 140 define filament aligning aperture portion 120 with length L3. First end portion 130 is not coplanar with intermediate portion 132. Similarly, second end portion 134 is not coplanar with intermediate portion 132.

To assemble cathode cup 82, focus tab 84, and filaments 86A, 86B, and 86C, focus tab 84 slides to engagement with filament coil receiving portion 94, and is positioned so that focus tab outer periphery 124 is substantially coextensive with filament coil receiving portion outer periphery 126. Particularly, plate 110 is inserted into first and second slots 106 and 108, with first end portion 130 sliding into slot 106 and second end portion 134 sliding into slot 108. Plate 110, as described above, is positioned within filament coil receiving portion 94 so that periphery 114 of filament aligning aperture 112 is adjacent filament lead openings 100. Filaments 86A, 86B, and 86C are then inserted into respective filament coil portions 128A, 128B, and 128C, of channels 98A, 98B, and 98C. Leads 90A and 90B of each filament 86A, 86B, and 86C, are inserted and extend through respective filament lead openings 100.

Assembly of the above described cathode cup assembly including focus tab 84 does not require a time consuming and cumbersome welding process. In addition, focus tab 84 facilitates proper filament coil positioning within the cathode cup.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. For example, cathode cup 82 described herein has three filament receiving channels 98A, 98B, and 98C. However, the cathode cup can have any number of filament receiving channels, and focus tab 84 can be modified for any number of channels. Accordingly, the spirit and scope of the invention are to be limited only by the terms of the appended claims.

What is claimed is:

1. A cathode cup assembly for an x-ray tube, said cathode cup assembly comprising:

a cathode cup comprising a filament coil receiving portion and a filament lead extension portion, said filament coil receiving portion comprising a plurality of filament receiving channels; and a focus tab comprising a plate having a filament aligning aperture, said focus tab configured to cooperate with said cathode cup so that said focus tab at least partially covers said channels.

2. A cathode cup assembly in accordance with claim 1 wherein said filament coil receiving portion of said cathode cup further comprises first and second flanges, said first and second flanges including respective first and second slots, each said slot extending substantially parallel to said channels, said channels located between said first and second flanges, and wherein said focus tab is configured to be positioned within said first and second slots.

3. A cathode cup assembly in accordance with claim 1 further comprising first and second filament lead openings in communication with one of said channels, said first and second filament lead openings extending from said channel through said filament lead extension portion of said cathode cup.

4. A cathode cup assembly in accordance with claim 3 wherein said focus tab is configured to be positioned so that a periphery of said filament aligning aperture is adjacent said first and second filament lead openings.

5. A cathode cup assembly in accordance with claim 3 further comprising a filament, said filament comprising a first filament lead, a second filament lead, and a filament coil extending between said first and second filament leads, said first filament lead extending through said first filament lead opening, and said second filament lead extending through said second filament lead opening.

6. A cathode cup assembly in accordance with claim 5 wherein said filament coil receiving portion of said cathode cup further comprises first and second flanges, said first and second flanges including respective first and second slots, each said slot extending substantially parallel to said channels, said channels located between said first and second flanges, and wherein said focus tab is configured to be positioned within said first and second slots so that a periphery of said filament aligning aperture is adjacent said first and second filament lead openings to limit positioning of said filament within said channel.

7. A method for assembling a cathode cup, filaments, and a focus tab, the cathode cup including a filament coil receiving portion and a filament lead extension portion, the filament coil receiving portion having a plurality of channels therein, said method comprising the steps of:

sliding the focus tab to engagement with the filament coil receiving portion of the cathode cup; and positioning the focus tab so that an outer periphery of the focus tab is substantially coextensive with an outer periphery of the filament coil receiving portion.

8. A method in accordance with claim 7 wherein the filament coil receiving portion includes first and second flanges having respective first and second slots, and wherein the channels are between the first and second flanges and substantially parallel to the first and second slots, and wherein the focus tab includes a plate having a filament aligning aperture, and wherein sliding the focus tab to engagement with the filament coil receiving portion includes the step of inserting the plate into the first and second slots.

9. A method in accordance with claim 8 wherein the cathode cup further includes first and second filament lead openings in communication with one of the channels, the first and second filament lead openings extending from the channel through the filament lead extension portion, and wherein sliding the focus tab to engagement with the filament coil receiving portion comprises the step of positioning the plate so that a periphery of the filament aligning aperture is adjacent the first and second filament lead openings.

10. A method in accordance with claim 9 further comprising the step of inserting one of the filaments into the cathode cup, the filament including a first filament lead, a second filament lead, and a filament coil extending between the first and second filament leads.

11. A method in accordance with claim 10 wherein inserting the filament into the cathode cup includes the step of positioning the filament coil within the channel, and inserting the first and second filament leads through the respective first and second filament lead openings.

12. A focus tab for a cathode cup, the cathode cup including a filament coil receiving portion and a filament lead extension portion, the filament coil receiving portion having a plurality of filament receiving channels, each of the channels sized to receive a filament, said focus tab comprising a plate with a filament aligning aperture therein, said plate configured to cooperate with the filament coil receiving portion so that said plate at least partially covers the channels and limits positioning of the filaments within the channels.

13. A focus tab in accordance with claim 12 wherein said plate comprises a first end portion, a second end portion, and an intermediate portion between said first and second end portions, said filament aligning aperture extending through said first end portion, said second end portion, and said intermediate portion.

14. A focus tab in accordance with claim 13 wherein said first end portion is not coplanar with said intermediate portion.

15. A focus tab in accordance with claim 13 wherein the filament coil receiving portion of the cathode cup further includes first and second flanges, the first and second flanges including respective first and second slots, each slot extending substantially parallel to the channels, the channels located between the first and second flanges, and wherein said focus tab is configured to be positioned within the first and second slots so that a periphery of said filament aligning aperture limits positioning of the filaments within the channels.

16. A focus tab in accordance with claim 15 wherein said first end portion is configured to slide within the first slot, and said second end portion is configured to slide within said second slot.

* * * * *